United States Patent [19]

Henneken et al.

[11] Patent Number: 4,881,869

[45] Date of Patent: Nov. 21, 1989

[54] FURNACE CHARGING THROAT CONSTRUCTION

[75] Inventors: Bernhard Henneken, Oberhausen; Burno Kämmerling, Dinslaken; Eckhard-K. Scholz, Bottrop; Wolfgang Schroeder, Oberhausen; Hans Krause, Moers, all of Fed. Rep. of Germany

[73] Assignee: Man Gutehoffnungshuette GmbH, Fed. Rep. of Germany

[21] Appl. No.: 195,116

[22] Filed: May 17, 1988

Related U.S. Application Data

[62] Division of Ser. No. 100,526, Sep. 24, 1987, abandoned.

[30] Foreign Application Priority Data

Sep. 26, 1986 [DE] Fed. Rep. of Germany ..... 3632724

[51] Int. Cl.[4] ..... C21B 7/18; E27B 1/20

[52] U.S. Cl. ..... 414/786; 266/44; 266/184; 414/202; 414/203; 432/98

[58] Field of Search ..... 414/786, 201–205; 266/184, 176, 44; 432/97, 98

[56] References Cited

U.S. PATENT DOCUMENTS

| | | | |
|---|---|---|---|
| 2,599,334 | 6/1952 | Latham, Jr. | 414/202 |
| 2,606,672 | 8/1952 | Avery | 414/203 |
| 2,718,971 | 9/1955 | Juengling | 414/203 |
| 2,736,440 | 2/1956 | Steckle et al. | 414/203 |
| 2,822,936 | 2/1958 | Hazle | 414/203 X |
| 3,152,703 | 10/1964 | Slagley, Jr. | 414/203 X |
| 3,759,404 | 9/1973 | Mahr | 414/203 |
| 3,799,369 | 3/1974 | Mahr | 414/203 |
| 3,877,686 | 4/1975 | Leonidov et al. | 414/201 X |
| 4,143,777 | 3/1979 | Nemstov et al. | 414/201 |
| 4,307,987 | 12/1981 | Legille et al. | 414/205 |

FOREIGN PATENT DOCUMENTS

| | | |
|---|---|---|
| 721977 | 10/1968 | Belgium . |
| 1036292 | 8/1958 | Fed. Rep. of Germany . |
| 143388 | 9/1970 | Fed. Rep. of Germany . |
| 1433322 | 11/1971 | Fed. Rep. of Germany . |

*Primary Examiner*—David A. Bucci
*Attorney, Agent, or Firm*—McGlew & Tuttle

[57] ABSTRACT

In a throat stopper for shaft furnaces, in particular blast furnaces with two hoppers of which an upper hopper is rotatable through a drive device, the upper hopper is designed, by a stationary hood equipped with charging flap valves, as a sluice chamber to be closed pressure-proof. For sealing the stationary hood relative to the rotatable upper hopper, there is disposed, at the hood, a peripheral flexible inflatable bellows. The bellows can be pressed against the wall of the upper hopper pneumatically or hydraulically. While material is being charged in the upper hopper, one of the charging valves is open and the bellows is pressureless. During, or shortly after, the charging, the upper hopper is rotated. For filling the lower hopper, the valves of the upper hopper are closed, bellows is inflated, and the upper sluice chamber is pressurized.

8 Claims, 2 Drawing Sheets

FURNACE CHARGING THROAT CONSTRUCTION

This is a division of application Ser. No. 100,526 filed Sept. 24, 1987, now abandoned.

BACKGROUND OF THE INVENTION

Field of the Invention

The invention relates to a furnace charging construction and in particular to a new and useful throat stopper for shaft furnaces, in particular blast furnaces with two hoppers, of which the upper hopper is rotatable via a drive device and to a method of operating the furnace charging construction.

Most of the known devices for introducing and distributing the charges for the burdening of blast furnaces are built on what is called the McKee principle. In this arrangement with two bells, a large bell in the lower region and a smaller bell in the upper region, the two bells being arranged one above the other, the upper hopper is rotatable.

The McKee throat stopper has the advantage, among others, that its overall height is relatively small, an advantage which is significant with respect to maintaining the lumpiness of the charged material. A disadvantage of this type of stopper, which may be termed a single-chamber stopper because the upper hopper is not formed as a sluice chamber, consists in that the sealing of the lower distributor bell relative to the sluice chamber wall constitutes a problem in particular because of the relatively large seal elements. This seal is, for one thing, under heavy stress due to wear by the abrasive charge material, but, for another, it is also problematical because of possible deformations due to uneven gas temperature distribution over the cross section of the furnace. As soon as a leak occurs at any point of the seal, dust particles are entrained with the outflowing gases due to the high pressure in this zone, and they will very soon increase the leaks. This source of dust constitutes an unacceptable environmental pollution, not to mention the fact that the seal elements must be replaced frequently.

To remedy this situation, it has been proposed before to design a throat stopper of this kind in such a way that the lower large bell need no longer from a gasproof seal. This is done in that the rotary distributor closed by the bell is disposed in a tightly closed envelope.

SUMMARY OF THE INVENTION

The invention provides a throat stopper where the problem of the seal between the lower distribution bell and the lower sluice chamber can be neglected but the advantages of the known furnace charging throat stopper construction with regard to a low overall height are preserved.

The invention adopts means different from the above mentioned known improvement. According to the present invention, the upper hopper is designed as a pressure-proof sluice chamber comprising a pressure-proof stationary hood placed on a rotary hopper.

The throat stopper according to the invention has a low overall height. This means a low height of fall for the charge material (coke, cinders, pellets, etc.) and, resulting therefrom, a small fines fraction of the charge material.

The seal problems no longer have the previously mentioned significance because with the double sluice, according to the invention, it is not possible that solids-laden gases are forced out of the blast furnace throat via the throat stopper into the atmosphere in an uncontrolled manner.

With the arrangement according to the invention, when the upper sluice chamber is placed under positive pressure for charging the lower sluice chamber, the inflated bellows at the hood of the upper hopper presses against the sluice chamber wall and provides for an absolute pressure-proof charging device. In accordance with the automatic charging program, the upper sluice hopper rotates during, or shortly after, the filling with the charging valve open and with the upper sluice chamber pressure less.

Accordingly, it is an object of the invention to provide a charging throat stopper construction for furnaces which includes a fixed hood and an upper hopper portion which is rotatably mounted below the hood and sealed thereto and which is driven by a drive connected thereto and which is equipped with at least one flap valve for opening and closing the hopper, said hopper having means for closing it so that it is pressure-tight.

A further object of the invention is to provide a furnace with a throat head entrance design for charging it which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figure 1:
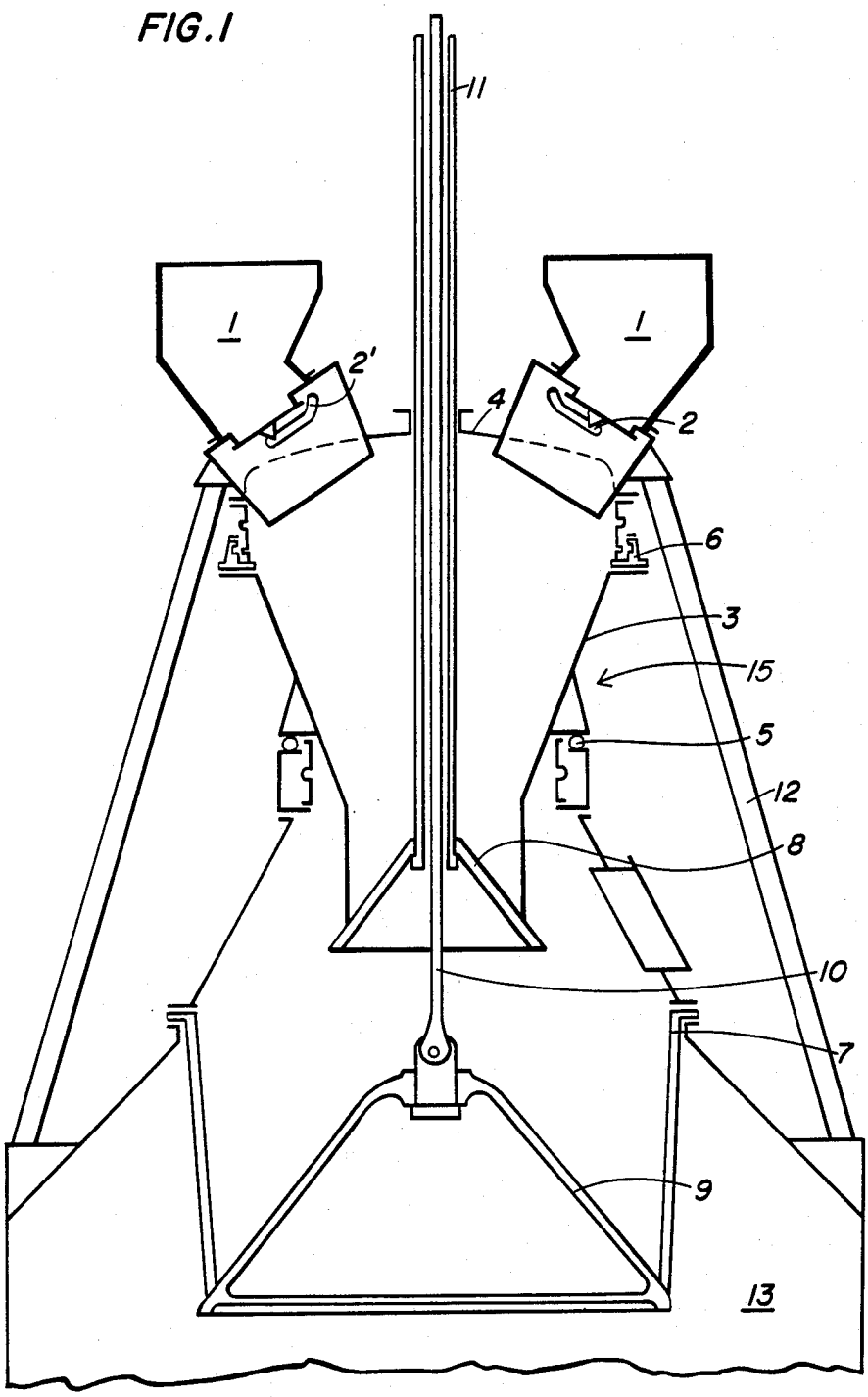
FIG. 1 is a transverse section through a double-sluice throat-stopper constructed in accordance with the invention.

Referring to the drawings, in particular, the invention embodied therein comprises a charging throat construction, particularly for blast furnaces which includes a fixed top or hood 4 which carries one or more furnace charging hoppers or chutes 1,1' each having a closeable charging flap valve 2. The hood 4 and the hoppers 1 are supported at a fixed elevation on struts 12.

In accordance with the invention, an upper rotatable sluice hopper 3 is rotatably mounted below the hood 4 in a position in which it can be sealed to the hood by sealing means 6 which can be applied or released and which, in the embodiment shown, comprises inflatable bellows. The feature of the construction is that the upper rotatable sluice hopper 3 is rotated by means of a drive 5 having associated rotation support above a lower hopper 7.

FIG. 1 shows the upper sluice region 13 of the blast furnace, called a blast furnace throat, with a double-sluice throat stopper 15 disposed thereabove. The throat stopper 15 comprises filling hoppers 1 and 1' charging flap valves 2,2' of a stationary hood 4. The throat also includes an upper sluice hopper 3 with a distributor bell 8, and a lower hopper 7 with a distributor bell 9.

The upper sluice hopper 3 can be set in rotation by a drive 5.

Figure 2:
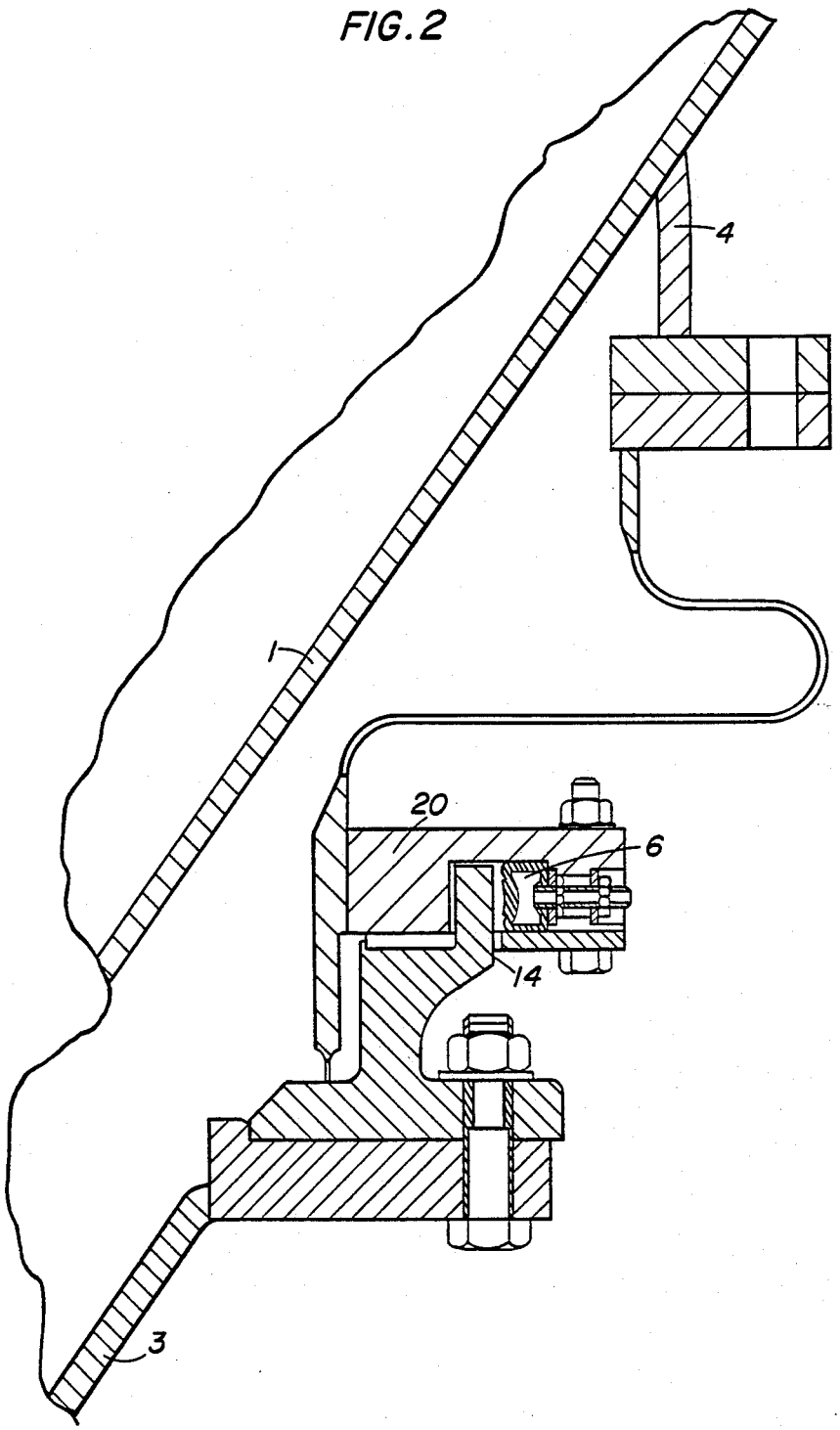
FIG. 2 is a detailed sectional view on a larger scale showing the seal between hood and sluice hopper by a flexible, inflatable balloon.

The stationary hood 4 is sealed relative to the upper rotatable sluice hopper 3 according to FIG. 2 by means of a peripheral flexible bellows 6. This bellows can be inflated pneumatically or hydraulically and, in the inflated state, it applies at 14 against the wall of the sluice hopper 3 and against a flange 20 on the hood 4.

FIG. 2 shows the bellows 6 in the pressureless state. The lower part of the hood 4 is compensatory in design.

When, for charging the lower sluice hopper 7, the upper sluice hopper 3 is set under positive pressure, the charging flap valves 2 are closed and the bellows 6 is inflated. The upper distributor bell 8 is lowered on the pipe 11, while the lower distributor bell 9 is in a closed position.

For charging the upper sluice hopper 3, one of the charging valves 2 is, as a rule, open, the bellows 6 is pressureless, and the distribution bell 8 is closed against the bottom of the upper hopper 3.

During the charging of the upper sluice hopper 3 or shortly after the filling, the sluice hopper 3 is set in rotation by means of the drive 5.

Opening of the lower distribution bell 9 by lowering the rods 10 takes place with the upper distributor bell closed.

While specific embodiments of the invention have been shown and described in detail to illustrate the application of the principles of the invention, it will be understood that the invention may be embodied otherwise without departing from such principles.

What is claimed is:

1. A method for operating a throat stopper for charging a shaft-type furnace which throat stopper has a hood member supported in an uppermost stationary position and includes at least one charging container with a flap valve directed to an upper sluice hopper which is rotatably supported below said hood member and is releasably sealable therewith to provide a pressure tight vessel and which also includes a first distributor bell member suspended so as to open and close the lower end of said upper sluice hopper, comprising charging said upper sluice hopper with material through said at least one charging container by opening the flap valve, rotating the upper sluice hopper after charging has begun with the upper sluice hopper and hood member in unsealed condition, ceasing said rotation, closing the flap valve and sealing an upper portion of said upper sluice hopper with a bottom portion of said hood after said rotation has ceased and permitting said upper sluice hopper to act as a sluice chamber.

2. A method according to claim 1, wherein selective ones of a plurality of charging containers are opened into said upper sluice hopper.

3. A method according to claim 1, wherein a distributor bell is suspended at the lower end of said upper sluice hopper and said first distributor bell is positioned to selectively close and open said upper sluice hopper during the charging.

4. The method according to claim 1, wherein said upper sluice hopper which is acting as a sluice chamber is placed under a positive pressure.

5. A method according to claim 4, wherein a lower hopper is positioned below said upper sluice hopper and a second distributor bell member is positionable to open and close a lower end of said lower hopper and wherein said first distributor bell member and second distributor bell member are regulated to control pressure and flow through said upper sluice hopper and said lower hopper, respectively.

6. A method for operating a throat stopper for charging a shaft-type furnace, which throat stopper has an uppermost hood member supported in a stationary position including at least one charging container with a flap valve extending to an upper sluice hopper which is rotatively supported below said hood member and is releaseably sealable therewith and which also includes a first distributor bell member suspended so as to open and close a lower end of said upper sluice hopper, a lower hopper positioned below said upper sluice hopper and a second distributor bell member positionable to open and close a lower end of said lower hopper, wherein said first and second distributor bell members are regulated to open and close, alternately, controlling pressure and flow of charging material through said upper sluice hopper and said lower hopper, which method comprises the steps of charging said upper sluice hopper with charging material through said at least one charging container by opening the flap valve, with the first distributor bell member positioned to close the upper sluice hopper, and the second distributor bell member positioned to close the lower hopper; rotating the upper sluice hopper, in unsealed condition with the hood after charging has begun; closing the flap valves when charging of the upper sluice hopper is complete; ceasing rotation of the upper sluice hopper; sealing an upper portion of the upper sluice hopper against a lower portion of the hood when the rotation has ceased; operating the first distributor bell member to open the lower end of the upper sluice hopper with the second distributor bell member closing the lower end of the lower hopper to discharge material from the upper sluice hopper to the lower hopper with the upper sluice hopper in pressure tight condition; and, subsequently, moving the first distributor bell member to a position to close the upper sluice hopper and moving the second distributor bell member to a position opening the lower end of the lower hopper to discharge material from the lower hopper through the lower end thereof with the pressure tight condition maintained.

7. A method according to claim 6 wherein the upper sluice hopper is placed in a condition of positive pressure when in pressure tight condition.

8. A method for charging a shaft-type blast furnace with coarse grade material having a throat stopper of the type comprising upper and lower hoppers with upper charge and lower discharge ends, respectively, and upper and lower bell members at respective discharge ends of respective hoppers which bell members are operable alternately to close and open respective of said lower discharge ends to enable charge and discharge of respective hoppers alternately, the upper hopper being rotatable relative to the lower hopper, a stationary hood member mounted covering the upper charge end of the upper hopper with chute means having a closeable valve for supplying coarse grade material to the upper end of the upper hopper, which method seals an upper portion of the upper hopper and a lower portion of the hood member together when the upper hopper is not rotating, and comprises the steps of opening the valve to charge the upper hopper with the upper bell member in closed condition and rotating the upper hopper after charging has begun; operating the valve to close the chute means; operating the sealing means to seal an upper portion of the upper hopper with a lower portion of the stationary hood member, and opening the upper bell member with the lower bell member in closed condition to charge the lower hopper from the upper hopper; operating the upper bell member to a closed condition and operating the lower hopper to an open condition to discharge the lower hopper to the furnace with the upper hopper sealed in a condition of positive pressure.

* * * * *